United States Patent [19]

Bilger et al.

[11] Patent Number: 4,876,939

[45] Date of Patent: Oct. 31, 1989

[54] DEVICE FOR REPOSITIONING AMMUNITION FEED OF AN AUTOMATIC WEAPON

[75] Inventors: Gerhard Bilger, Lauterbach; Helmut Mader, Schramberg; Erich Matzagg, Oberndorf/Beffendorf, all of Fed. Rep. of Germany

[73] Assignee: Mauser-Werke Oberndorf GmbH, Oberndorf, Fed. Rep. of Germany

[21] Appl. No.: 177,632

[22] Filed: Apr. 5, 1988

[30] Foreign Application Priority Data

Apr. 7, 1987 [DE] Fed. Rep. of Germany ..... 3711690

[51] Int. Cl.[4] ..... F41D 10/32

[52] U.S. Cl. ..... 89/33.04

[58] Field of Search ..... 89/33.04

[56] References Cited

U.S. PATENT DOCUMENTS

| | | | |
|---|---|---|---|
| 3,875,845 | 4/1975 | Hupp et al. | 89/33.04 |
| 4,333,386 | 6/1982 | Montgomery | 89/33.04 |
| 4,416,185 | 11/1983 | Schenk | 89/33.04 |
| 4,505,181 | 3/1985 | Schneider et al. | 89/33.04 |
| 4,539,890 | 9/1985 | Bosshard | 89/33.04 |
| 4,562,768 | 1/1986 | Weinfurth et al. | 89/33.04 |
| 4,612,843 | 9/1986 | Marcon et al. | 89/33.04 |

FOREIGN PATENT DOCUMENTS

| | | | |
|---|---|---|---|
| 1557304 | 1/1969 | France | 89/33.04 |

*Primary Examiner*—Charles T. Jordan
*Assistant Examiner*—Michael J. Carone
*Attorney, Agent, or Firm*—McGlew and Tuttle

[57] ABSTRACT

With the device a repositioning of ammunition feeds of an automatic weapon into various feed positions and a secured position is achieved. The selective positioning is achieved by a lever which is pivotally supported alongside a drive shaft and abuts by an integrally formed cam at one end face of a pivoting support part axially against a sleeve which is axially displaceable on the drive shaft. The sleeve is under the biasing force of a spring. The end face of the sleeve biasing toward the pivoting support part of the lever possesses also a cam which is in operative connection with a cam of the pivoting support which upon engagement effects a coupling driving engagement of the lever with the shaft. The mechanism acts to hold the lever of the ammunition feed in a respective position by means of the spring.

8 Claims, 3 Drawing Sheets

DEVICE FOR REPOSITIONING AMMUNITION FEED OF AN AUTOMATIC WEAPON

BACKGROUND OF THE INVENTION

Field of the Invention

The invention relates in general to firearms and in particular to a new and useful method and device for positioning ammunition feeds of an automatic weapon to bring them into different feed positions and into a secured position.

From German Patent No. DE-PS 23 03 953 an automatic firearm with an advancing and retracting breech and with a cartridge feed device is known, by which at least two different types of ammunition can, by switching, be brought into the supply path of the breech. As can be seen from FIG. 4 of th German patent document referred to, a twin belt feed is introduced and supported for transverse displacement in the cradle (not shown in detail) of the automatic weapon. The drive head has been brought into its guideways and locked, so that the position of the belt feed relative to the housing of the weapon is exactly defined. The belt guides and the compartments of empties are snapped in at the belt feed housing directly. Thus, the ammunition can be moved up to the cartridge stop by the transport star wheels in every position of the belt feed. By very simple mechanical means, which can be adapted to the respective type of mount, as for instance a turret or field mount, a controlled transverse displacement of the belt feed is now chosen at start of firing, so that the desired type of ammunition is immediately available. At the start of firing, the breech takes along the cartridge which is in a feed position and exactly fixed by the belt element and the transport star wheel, and introduces it into the cartridge magazine. If there is a change of ammunition, the ammunition feed is moved from the position occupied until then, i.e. transversely to the breech, until the belt with the new ammunition is in readiness for the removal of cartridges by the breech. This then is the second ammunition feed position.

Between the two ammunition positions is the so-called secured position, in which the breech cannot grip the cartridges either of the first or of the second belt.

Due to the large number of parts needed for guiding and supporting the ammunition feed, manufacturing tolerances add up, and it can therefore not be insured that the ammunition feed stands exactly in a respective feed position or in a central secured position.

SUMMARY OF THE INVENTION

The invention provides a firearm with safe operation of the ammunition feed and a mechanism to fix it exactly in its respective positions.

With a lever the ammunition feed is moved between either a desired feed position or a secured position. Engaging into the lever is a sleeve providing a connecting element to the drive shaft which is mounted for axial displacement on the drive shaft by a splined shaft section. Having been moved into an end position, the feed is limited by a stop. With further rotation of the drive shaft the sleeve rises out of the central position engaged in its cam along a corresponding cam path of the pivoting support. By the spring disposed at the other end of the sleeve the sleeve is set under axial kinetic pressure. The ammunition feed is thereby continuously pressed against its respective stop via the lever. In this new design, therefore, manufacturing tolerances no longer play a determining role.

Accordingly it is an object of the invention to provide an improved method of feeding plurality of different types of ammunition to a single weapon which comprises arranging a plurality of separate feed mechanisms each capable of feeding a selected ammunition in a housing which is movable on the track way of the weapon adjacent the weapon breech and including shifting the housing with the feeding mechanism to selectively align a feed in a position in which it will feed its ammunition to the breech.

A further object of the invention is to provide a device for positioning a plurality of different ammunition feeding devices which are selectively positionable between an operable position and a non-operable or secured position, so as to selectively feed different ammunition types to a weapon breech, which comprises a rotatable drive shaft with a shifting lever having a driving end adjacent to drive shafts and an opposite engagement end which engages with the different ammunition shifting devices in which there is coupling means defined between the drive shaft and the lever for rotating the lever to move the feeding devices into and out of operable positions.

A further object of the invention is to provide a weapon which is simple in design, rugged in construction, and economical to manufacture.

The various features of novelty which characterize the invention are pointed with particularity in the claims annexed to and forming a part of this disclosure. For a better understanding of the invention, its operating advantages and specific objects obtained by its uses, reference is made to the accompanying drawings and descriptive matter in which preferred embodiments of the invention are illustrated.

GENERAL DESCRIPTION OF THE PREFERRED EMBODIMENTS

Figure 1:
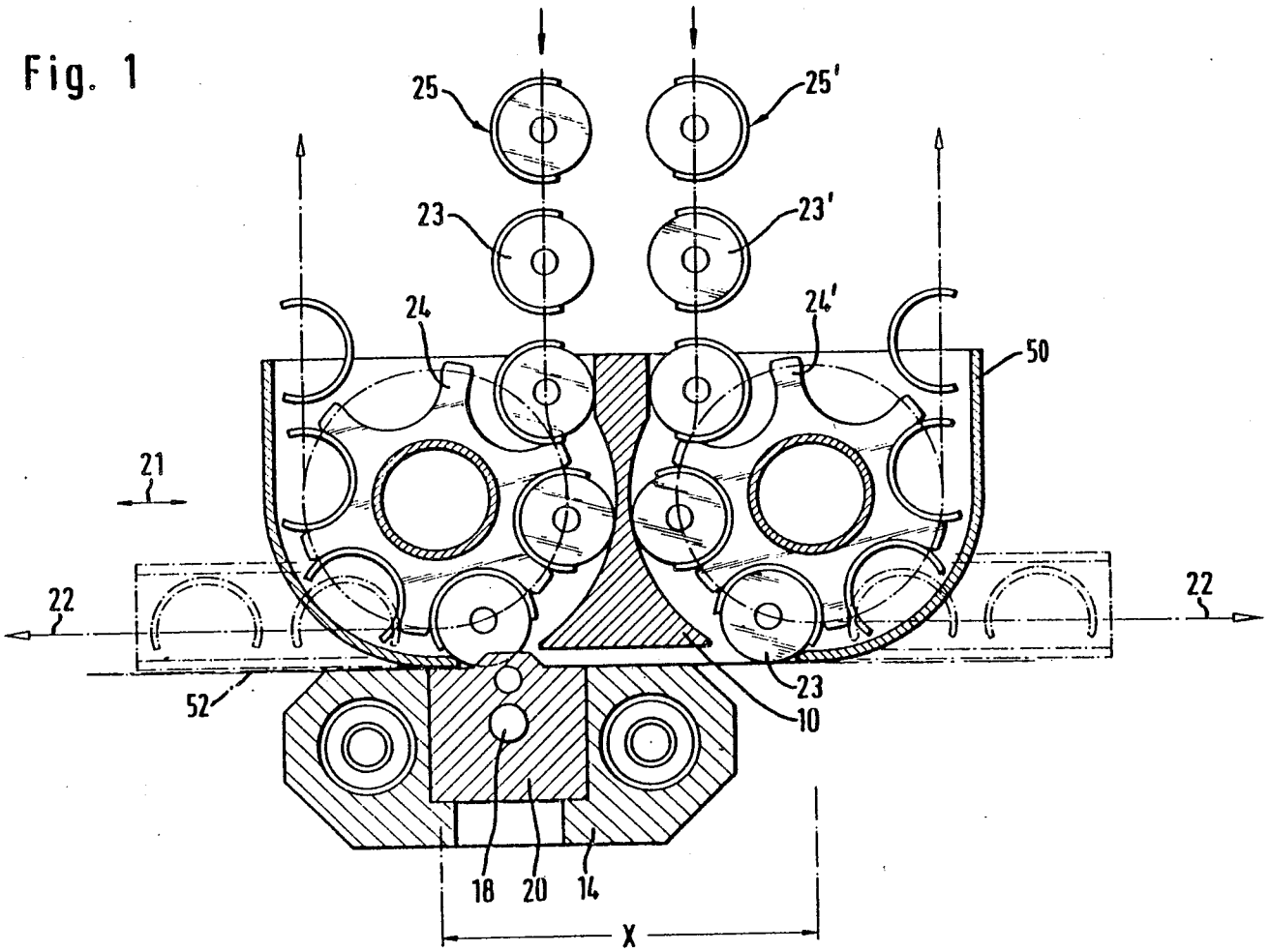
FIG. 1 is a systematic transverse sectional representation of two ammunition feeds with an associated breech constructed in accordance with the invention.

Referring to the drawings in particular the invention embodied therein comprises a weapon which has a plurality of the different feeding devices which are contained in a housing 50 which is movable along a trackway 52 for selectively positioning feeding devices to feed ammunition designated 2 and ammunition designated 23'. The mechanism when aligned with a breech 20 will operate to feed the ammunition into a weapon 14, and when they are not so aligned they can be moved into a secured position in which they are not used at all, or a standby position where the other of the two ammunition feeding devices are aligned for operations.

From the diagrammatic showing in FIG. 1 can be seen ammunition holding belts 25 with inserted cartridges 23, which are conveyed to transport star wheels 24 and are deflected by them into corresponding curved paths. Between the two transport star wheels 24 is an ammunition feed device 10. Below the ammunitions admission the firearm or weapon 14 with a breech 20 can be seen. Now the ammunition feed device 1 together with the transport star wheels 24 above the breech 20 is displaceable transversely on the theoretical displacement path X. The transverse mobility is indicated by the double arrow 21 The arrows 22 laterally of the transport wheels 24 indicate that instead of the deflection of the belt 25 by 180° a deflection by only 90° with lateral conduction of the belts is possible.

The device for repositioning ammunition feeds the ammunition in an automatic weapon and it includes a lever 1 which with its pivoting support 11 is pivotally mounted on a drive shaft 2. At its end away from the pivoting support 11, lever 1 has a fork 17 which movably receives the driver pin 18 of the ammunition feed 10.

The pivoting support 11 is in operative connection by an axial end face with a sleeve 3 which is mounted for longitudinal displacement on the drive shaft 2 by a splined shaft portion or section 8 and is under the action of a spring 4. Spring 4 is braced on the bottom of a housing 7, which further surrounds cylindrically both the spring 4 and also the sleeve 3 and parts of the pivoting support 11. The drive shaft 2 is rotationally connected with a drive sleeve 5 by a tappet 6 and can be rotated in both directions as indicated by the double arrow 26. The end face of sleeve 3 toward the pivoting support 11 has a cam 9 consisting of two symmetrical discrete cams 9.1 and 9.2 axially ascending at an angle in the longitudinal axis of the sleeve. The end face of the pivoting cartridge support 11 toward sleeve also has a cam 19 with two symmetrical discrete cams 19.1 and 19.2.

Figures 2, 3:
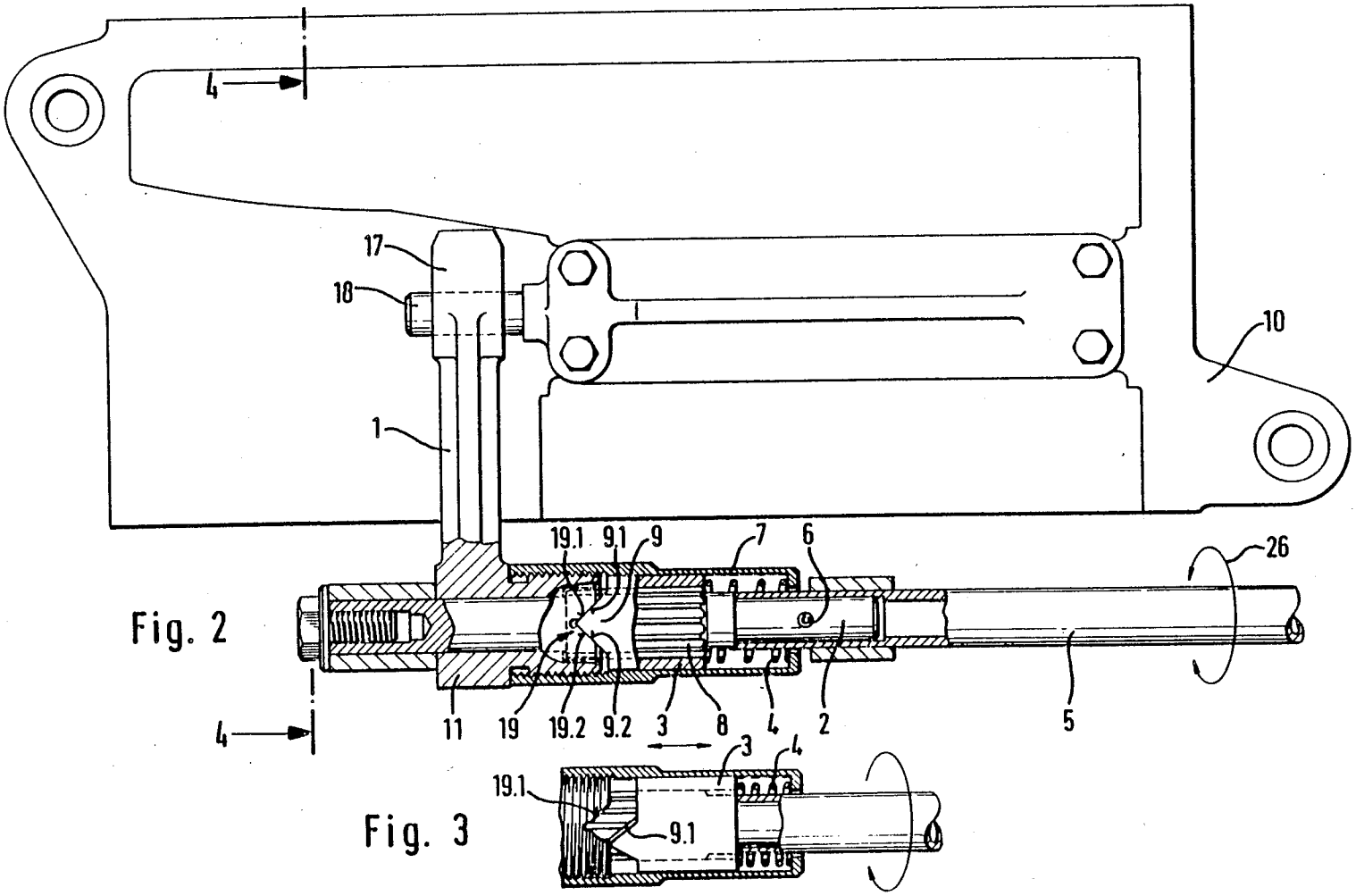
FIG. 2 is a side elevational and partial sectional view of the device for repositioning ammunition feeds.
FIG. 3 is a view similar to FIG. 2 of the drive shaft with the sleeve in a displaced position; and, FIG. 4 is a side view partly in section of the device for repositioning ammunition feeds taken along the line 4—4 of FIG. 2.
Figure 4:
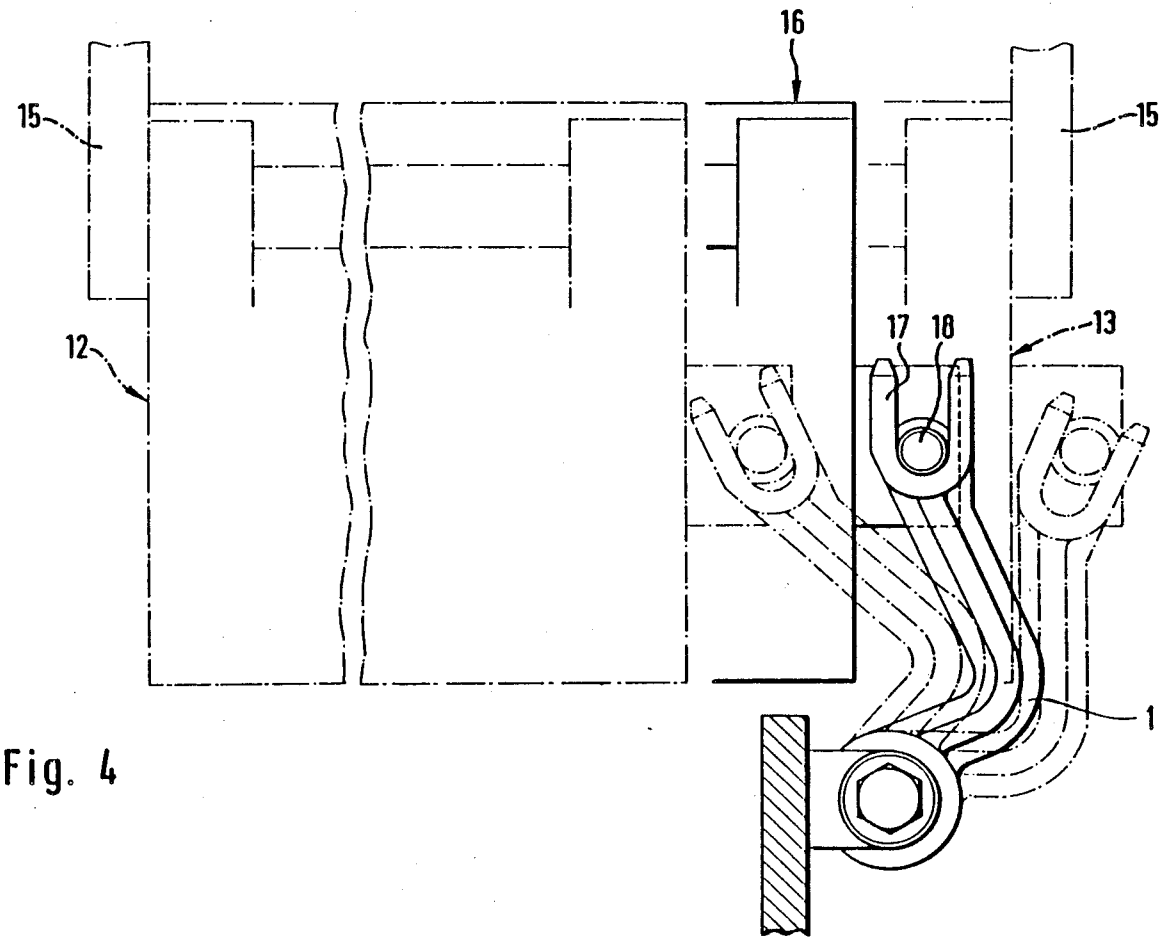

In the central position illustrated in FIG. 2, which is the secured position 16 of the ammunition feed 10, the cam 9 of sleeve 3 and cam 19 of the pivoting cartridge support are fully coincident. When lever 1 is pivoted for the purpose of repositioning an ammunition feed lo from the central secured position 16 to one of the opposite end stops 15 and 15', the cam 19 with its discrete cam 19.1 or 19.2 is displaced on either the discrete cam 9.1 or 9.2 of sleeve 3. The sleeve on drive shaft 2, therefore executes an axial movement counter to the force of spring 4. Due to the fact that lever 1 is at first in the end position at a stop 15 and moreover the drive shaft 2 rotates a little farther, there results via cams 9 and 19 and due to spring 4 a pressure onto lever 1 which thereby presses the ammunition feed 10 in the respective end position against the associated stop 15 or 15'. By these lever movements a repositioning from the ammunition 12 to an ammunition type 13 is ensured with secure end position although only one compression spring 4 has been employed.

In the central secured position the cams 9 and 19 are in coincidence, which is equivalent to a locked engagement.

By the described device there is brought about a repositioning of ammunition feeds 10 of an automatic weapon selectively into several feed positions and a secured position. The movement occurs through the lever 1, which with its pivoting support 11 is in operative connection with a sleeve 3. This sleeve 3 in turn is mounted for axial displacement on a drive shaft 2 by means of a splined shaft section 8. If the ammunition feed 10 is in an end position, it is a first limited by a stop 15. Through the onward rotation of drive shaft 2 the sleeve 3 rises along cam 9 or 19. Spring 4 strives to push sleeve 3 back, whereby the ammunition feed 10 is pressed continuously against the respective stop 15 via lever 1.

While specific embodiments of the invention have been shown and described in detail to illustrate the application of the principals of the invention, it will be understood that the invention may be embodied otherwise without departing from such principles.

What is claimed is:

1. A device for positioning a plurality of different ammunition feeding devices which are selectively positionable between an operable position and a secured position so as to selectively feed different types of ammunition to a weapon breech, comprising a rotatable drive shaft, a shifting lever having a driving end adjacent said drive shaft and an opposite engagement end engageable with the different ammunition feeding devices, and coupling means defined between said drive shaft and said lever for rotating said lever in response to rotation of said drive shaft so as to move a selected ammunition feeding device into and out of an operable position.

2. A device according to claim 1, wherein said lever engagement end has a frontal cam, a sleeve carried on said drive shaft and being axially displaceable, a housing engaged over said drive shaft and accommodating said sleeve and engageable with said lever, said sleeve having an intricately formed sleeve cam which is axially displaceable on said drive shaft and, including spring means biasing said sleeve in a direction to engage said sleeve cam with said frontal cam for driving said lever with said drive shaft.

3. A device according to claim 2, wherein said shaft has a splined shaft section which positively connects said sleeve with said drive shaft.

4. A device according to claim 3, wherein said sleeve includes two symmetrical divergent portions which ascend at an angle axially in the longitudinal axis of said sleeve, said frontal cam of said lever arm engagement end comprising discrete cam parts which slidingly engage with said sleeve cam portions.

5. A device according to claim 4, wherein said sleeve cam parts have surfaces which extend at an angle to each other.

6. A device according to claim 2, wherein said lever is pivotal between two opposite feed positions, a stop arranged at each of said feed positions against which said lever is stopped, said sleeve cam and said frontal cam being in coincidence with each other at a central position between said stop positions.

7. A weapon having a breech, a plurality of ammunition feeds, means mounting said ammunition feeds for selectively positioning each of said ammunition feeds into association with said breech for delivering ammunition to the breech, a feed drive shaft, a lever having an interior end mounted adjacent said feed drive shaft and having an opposite end engageable with said mounting means for said plurality of ammunition feeds, and coupling means for connecting said lever to said drive shaft so as to shift said mounting means for said plurality of ammunition feeds to position a selective feed in operative and non-operative positions.

8. A weapon according to claim 7, wherein said lever has an engagement end which is threaded exteriorly, a housing threaded over said engagement end and having an axial opening, a drive sleeve having a hollow end extending through said opening, said drive shaft being connected to said sleeve for rotation therewith, and extending in said housing and having a spline portion in said housing opposite to said interior end of said lever, said lever and said drive shaft having inter-engageable cams which are provided with a wedge shaped axial extension of one and a receiving wedge shaped recess of the other so that they interengage, and spring means disposed between said splined portion of said shaft and said housing.

* * * * *